United States Patent [19]

Lewis

[11] Patent Number: 4,625,635

[45] Date of Patent: Dec. 2, 1986

[54] BANDING APPARATUS FOR PRESSES

[76] Inventor: Charles B. Lewis, 7451 SW. Coho Ct., Tualatin, Oreg. 97062

[21] Appl. No.: 702,928

[22] Filed: Feb. 19, 1985

[51] Int. Cl.[4] ..... B65B 13/14

[52] U.S. Cl. ..... 100/26; 53/589; 100/3

[58] Field of Search ..... 100/3, 25, 26; 53/529, 53/589

[56] References Cited

U.S. PATENT DOCUMENTS

| | | | |
|---|---|---|---|
| 2,959,118 | 11/1960 | Hager | 100/26 |
| 3,213,780 | 10/1965 | Neitzel | 100/26 X |
| 3,521,550 | 7/1970 | Van Doorn et al. . | |
| 3,834,297 | 9/1974 | Huson | 100/26 X |
| 4,403,542 | 9/1983 | Lewis . | |
| 4,534,817 | 8/1985 | O'Sullivan | 100/26 X |
| 4,561,349 | 12/1985 | Grenon | 100/26 |

*Primary Examiner*—Billy J. Wilhite
*Attorney, Agent, or Firm*—Eugene M. Eckelman

[57] ABSTRACT

A band feeder and knotter having a band guide track mounted on one side of a banding area and an opposite guide track is mounted on the other side of the banding area in lateral alignment with the track of the band feeder and knotter. At least one of the band feeder and knotter or the opposite guide track is movable toward and away from the other for disposition of the tracks from a retracted position to a closely adjacent advanced position inside a banding area for direct advancement during a banding process of the end of the banding from one track into the other. Each of the band feeder and knotter and the opposite guide track can be mounted on carriages for cooperating movement in the advancing and retracting movement.

1 Claim, 4 Drawing Figures

BANDING APPARATUS FOR PRESSES

BACKGROUND OF THE INVENTION

This invention relates to new and useful improvements in apparatuses which apply a band around articles in a press.

Banding mechanisms have heretofore been provided in combination with presses for applying a band, such as a wire or strap, around pressed articles to hold the article in its pressed condition. In applying the band to the pressed articles, it is necessary that the band pass through the press for cooperation with opposed track means which return the end of the band to the knotter for securement. Existing presses employ track segments within the press to guide the band from its feeding mechanism to the opposite side and also to return the band back to the knotter. This requires the end of the advancing wire to thread through the open ends of these several segments as it advances around the article. Therefore, the end of the wire is capable of snagging at each of the openings to the intermediate segments and to the openings to the tracks on the banding means, and if the press includes two segments on each of the top and bottom, for example, there are six possibilities for the wire to foul. Each time the wire fouls of course means downtime for the press.

SUMMARY OF THE INVENTION

According to the present invention and forming a primary objective thereof, banding apparatus is provided which is capable of feeding band material around an article independent of any track segments within the press, thus reducing to a minimum the possibility of fouling of banding material being fed endwise around a pressed article.

It is also an object of the invention to provide a combination banding means and press construction which accomplish the above objective.

In carrying out the invention, band feeding and knotter means having guide track means are mounted on one side of the banding area and track means for receiving the band material from the feeding means and directing it around the article being pressed and back to the knotter are provided on the opposite side of the banding area. Drive means are provided to move at least one of the band feeding and knotter means or the opposite track means toward and away from the other for disposition of the track means between advanced and retracted positions. The track means have a dimensional relationship whereby to be closely adjacent each other in said advanced position for direct advancement during a banding process of the end of the banding from one track to the other track. Carriage support of one or both of the band feeding and knotter means and the opposite track means is provided to move them between the advanced and retracted positions. Press means used with the present banding apparatus has lateral openings for receiving the tracks of the present invention.

The invention will be better understood and additional objects and advantages will become apparent from the following description taken in connection with the accompanying drawings.

DETAILED DESCRIPTION OF A PREFERRED EMBODIMENT

Figure 1:
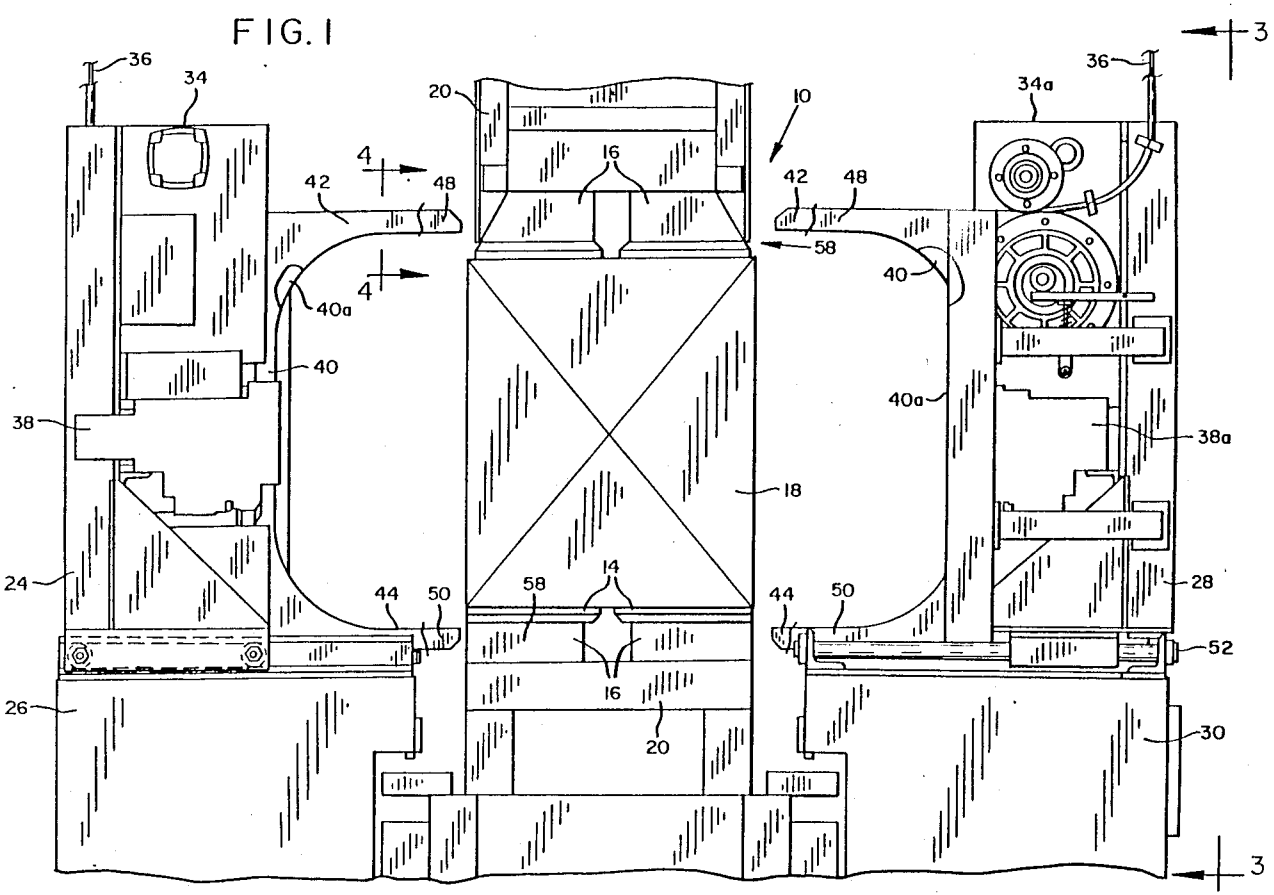
FIG. 1 is an end elevational view of banding mechanism of the invention in combination with a press, the banding mechanism being shown in retracted position.

With particular reference to the drawings, the numeral 10 designates generally a banding area, namely, a press having upper and lower platens 12 and 14, respectively, comprising a pair of plungers or suitable supports 16 capable of compressing an article 18. Supports 16 and supporting structure 20 therefor are conventional. In previous structures, laterally extending tracks have been mounted within the press in association with the plungers 12 and 14 for receiving banding material from laterally disposed cooperating banding apparatus, and as will now become apparent and in accordance with the invention, the press itself does not employ any track means whatsoever for the banding material.

In accomplishing the invention, a first carriage 24 is supported on a suitable base 26 on one side of the banding area and a second carriage 28 is supported on a base 30 on the opposite side of the banding area. The base members 26 and 30 are of conventional construction providing adjustment of the carriages longitudinally of the article for applying banding at spaced intervals therealong if necessary.

Carriage 24 includes conventional feeding mechanism 34 for banding material 36 from a suitable supply, not shown. Carriage 24 also supports conventional band knotter means 38 arranged to tie the band after it has been passed around the compressed article 18.

Similarly, carriage 28 has conventional feeding mechanism **34*a* for banding material 36 from a source independent of the source for carriage 24. Each of the carriages supports one or more pairs of band guide tracks 40 and 40*a* in a symmetrical but reversed position from that of respective tracks 40*a* and 40 on the other side. Track 40 has upper and lower track arms 42 and 44, respectively, and track 40*a* has upper and lower track arms 48 and 50, respectively. Portions of the tracks and track arms are broken away in FIG. 1 to show the symmetrical and reverse relationship thereof. The feeding mechanism 34 on carriage 24 feeds a band, by means of its track arm 42 to an oppositely aligned track 48 on carriage 28, and the feeding mechanism 34*a* on carriage 28 feeds a band, by means of its track arm 42 to an oppositely aligned track arm 48. In a banding sequence, the band is fed from its feeding mechanism 34 or 34*a* through its track arm 42, then into opposite track arm 48, then around the back side of the article being pressed and out of the track arm 50 to opposite track arm 44** and to the knotter at the initiating feeding mechanism. A pair of opposed bands can be formed simultaneously from opposite directions by completion of a band moving in aligned tracks in the respective feeding and return portions.

Figure 2:
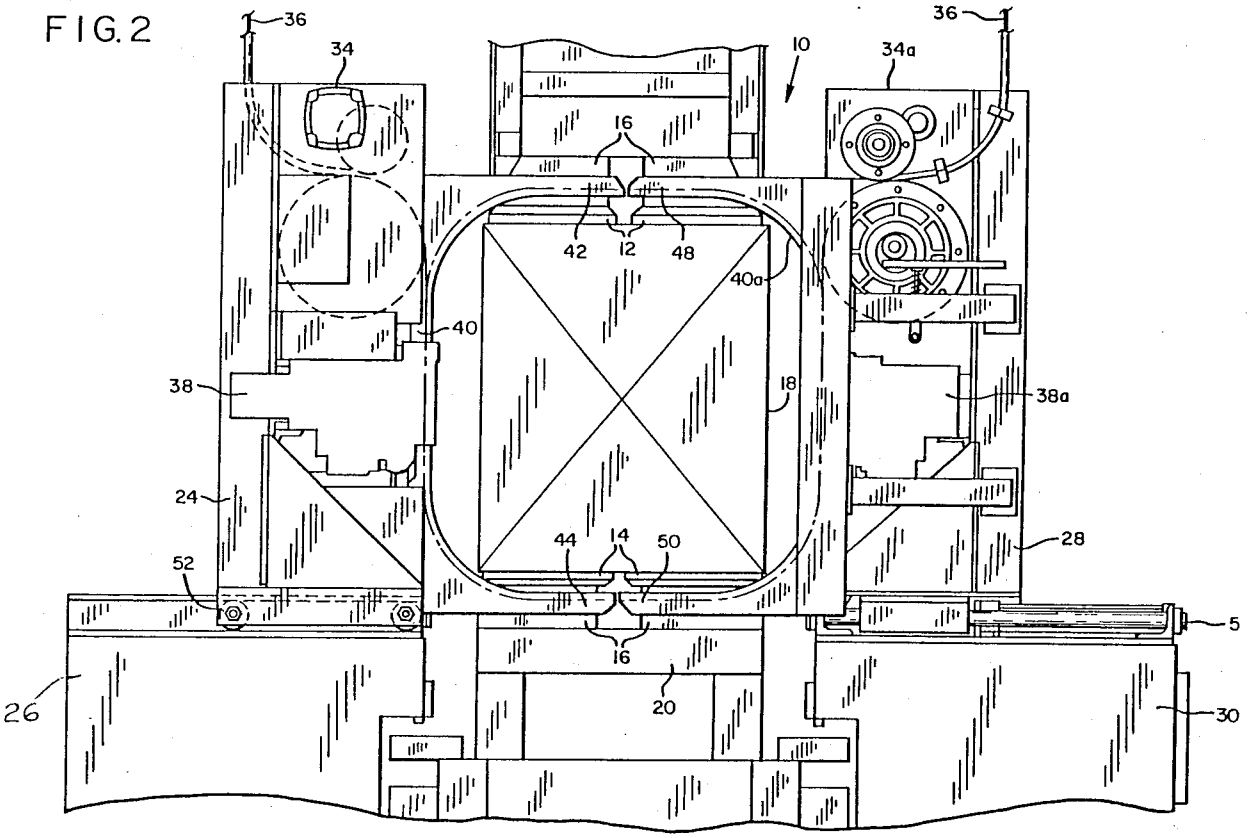
FIG. 2 is an end elevational view similar to FIG. 1 except that the banding mechanisms are shown in advanced position ready for a banding process.
Figure 3:
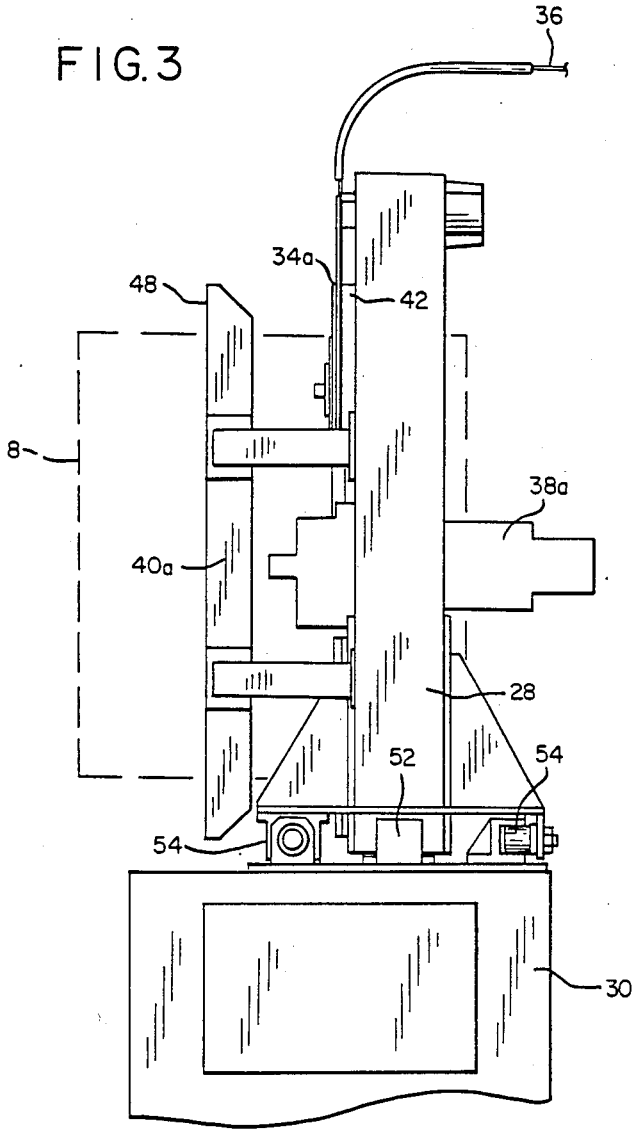
FIG. 3 is a side elevational view taken on the line 3—3 of FIG. 1.
Figure 4:
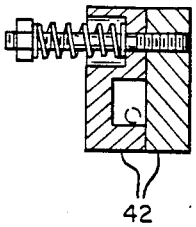
FIG. 4 is an enlarged fragmentary sectional view taken on the line 4—4 of FIG. 1.

The two carriages have advancing and retracting movement relative to each other by means of conventional power drive means 52, such as fluid operated cylinders, and conventional guide means 54. The arms 42, 44, and 48, 50 on the track means 40 and 40*a*, respectively, are of a length to extend essentially halfway into the press whereby in the fully advanced or closed position of the carriages, FIG. 2, the end edges of the arms are touching or closely associated within the banding area, such as within a fraction of an inch, whereby in this meeting relationship of the track means the end of band material being fed will readily thread from one track arm to the other in substantially a closed loop without fouling. In connection with this structure, intermediate track segments are not necessary in the area within the press, whereby as the band is fed around the article 18, and with the carriages in their advanced position, the banding needs only to thread through two spaces between the arms, namely, through one space at the top and through one at the bottom. As stated, this minimizes the possibility of the end of the wire fouling in the mechanism. Lateral openings 58 are provided in the press between the platens or at the ends thereof, as necessary, to receive the arms 42, 44 and 48, 50.

It is to be understood that the form of my invention herein shown and described is to be taken as a preferred example of the same and that various changes in the shape, size and arrangement of parts may be resorted to without departing from the spirit of my invention, or the scope of the subjoined claims. For example, the track arms 40, 42 and 48, 50 may have a length dimension such that it is necessary for only one of the band feeding and knotter mechanism and opposite track to be carriage mounted.

Having thus described my invention, I claim:

1. A banding station comprising a banding area for receiving articles to be bound, a first carriage on one side of said banding area, a second carriage on the other side of said banding area in lateral alignment with said first carriage, banding drive means on at least one of said carriages arranged to drive banding lengthwise, track means on said first carriage arranged to receive banding from said banding drive means and direct it partly around an article, track means on said second carriage arranged to receive banding from the track means on said first carriage for directing a band around an article, and drive means arranged to move at least one of said carriages toward and away from the other for disposition of the track means on the carriages from a retracted position to a closely adjacent position inside said banding area for direct advancement during a banding process of the end of the banding from one of said carriage track means into said other carriage track means, and press means having upper and lower press platens in said banding area, said press means having lateral openings for receiving said track means in their closely adjacent position.

* * * * *